US007053026B2

(12) United States Patent
Li

(10) Patent No.: US 7,053,026 B2
(45) Date of Patent: May 30, 2006

(54) BASE OIL BLENDS FOR CONVEYOR CHAIN LUBRICATING COMPOSITIONS

(75) Inventor: Hsinheng Li, Mt. Pleasant, MI (US)

(73) Assignee: The Lubrizol Corporation, Wickliffe, OH (US)

( * ) Notice: Subject to any disclaimer, the term of this patent is extended or adjusted under 35 U.S.C. 154(b) by 297 days.

(21) Appl. No.: 10/399,995

(22) PCT Filed: Oct. 11, 2001

(86) PCT No.: PCT/US01/42684

§ 371 (c)(1),
(2), (4) Date: Apr. 23, 2003

(87) PCT Pub. No.: WO02/34868

PCT Pub. Date: May 2, 2002

(65) Prior Publication Data

US 2004/0014611 A1 Jan. 22, 2004

Related U.S. Application Data

(60) Provisional application No. 60/243,217, filed on Oct. 25, 2000.

(51) Int. Cl.
*C10M 111/04* (2006.01)
*C10M 169/04* (2006.01)

(52) U.S. Cl. ..... 508/214; 508/485; 508/591

(58) Field of Classification Search ..... 508/208, 508/214, 591
See application file for complete search history.

(56) References Cited

U.S. PATENT DOCUMENTS

| | | | | |
|---|---|---|---|---|
| 4,929,372 | A * | 5/1990 | Akanuma et al. | 508/112 |
| 5,047,159 | A | 9/1991 | Zehler | 252/49.6 |
| 5,151,205 | A * | 9/1992 | Culpon, Jr. | 508/485 |
| 5,227,551 | A * | 7/1993 | Bachman et al. | 585/12 |
| 5,329,055 | A * | 7/1994 | Bachman et al. | 585/12 |
| 5,898,022 | A * | 4/1999 | Maples | 508/113 |
| 6,436,881 | B1 * | 8/2002 | McHenry et al. | 508/280 |

FOREIGN PATENT DOCUMENTS

EP 0714972 B1 5/1999

OTHER PUBLICATIONS

PCT Search Report dated Aug. 1, 2002 for corresponding International Publication No. WO 02/034868 A3.
Abstracts of Japanese Patent No. 58103594 dated Dec. 16, 1981, European Patent Office-Patent Abstracts of Japan, 1983, JPO&Japio.
Abstract of Japanese Patent No. 560079194 dated Jun. 29, 1981, European Patent Office-Patent Abstracts of Japan, 1981, JPO&Japio.

* cited by examiner

*Primary Examiner*—Ellen M. McAvoy
(74) *Attorney, Agent, or Firm*—Samuel B. Laferty; Michael F. Esposito

(57) ABSTRACT

A conveyor chain oil for use at elevated temperatures is described comprising a blend of a polyol ester, a poly (isobutylene), and a mineral oil. The blend has low volatility compared to the volatility of its individual components, suffers little change in viscosity with use, and resists the formation of undesirable sludge or varnish.

16 Claims, No Drawings

BASE OIL BLENDS FOR CONVEYOR CHAIN LUBRICATING COMPOSITIONS

This application claims benefit of Ser. No. 60/243,217 filed Oct. 25, 2000.

FIELD OF THE INVENTION

Chain lubricants minimize frictional resistance and wear in a variety of commercial and other applications, where chains are part of a conveying system, e.g. roller chains. They typically have a high viscosity so their viscosity can be reduced at high temperatures to spread to all of the parts of the chain that come in frictional contact with other materials while not dripping from the chain. Chain lubricants are reapplied periodically to replace lost lubricant.

BACKGROUND OF INVENTION

Conventional chain lubricants for low temperature applications are usually mineral oil based for cost reasons. Chain lubricants for higher temperature applications, e.g. where the chain passes through an oven, may be polyol ester based lubricant to prolong the periods between lubricant replenishment and to minimize the amount of deposits on the chain surfaces due to oxidation. Inadequate lubrication causes chain wear and increased operational costs due to increased energy consumption. Inadequate lubrication can be from lack of lubricant or from a lubricant of insufficient viscosity to maintain a lubricious film of sufficient thickness. The build up of oxidation products on chains may require chain cleaning and or replacement.

Chain lubricants desirably have low volatility, retain fairly constant viscosity over the life of the lubricant, and do not form sludge or varnish on the chain due to oxidation or other degradation reactions. Volatility is usually associated with both the vaporization and the breakdown of the lubricant into lower molecular weight volatile components. Sludge and/or varnish formation is usually associated with molecular weight build-up due to the polymerization of degraded lubricant molecules.

While conventional mineral oil based lubricants for chains work well at 100° C. and even slightly higher, elevated temperatures tend to volatilize the mineral oil and cause oxidation reactions that form sludge deposits on the chain. Addition of more oil can compensate for evaporation, but the formation of deposits generally requires cleaning the chain with a varnish remover product. Depending on the length of the chain, the complexity of the chain and associated hardware to carry the part, and the complexity of the equipment, which the chain passes through, the chain cleaning can be quite complicated and expensive. Further the solvents necessary for effective varnish removal tend to be regulated as environmental hazards in terms of worker exposure and recycling or discarding.

Polyol esters have better thermal and oxidative stability than mineral oil but are several times more expensive than mineral oils. Polyol esters however have some affinity for water, which water can promote cleavage of the ester bonds yielding carboxylic acids and half esters. The carboxylic acids can contribute to metal corrosion. Polyol esters are preferred over mineral oils for higher temperature applications such as above 125, 150 or 180° C.

SUMMARY OF INVENTION

While the use of mineral oils or polyol esters has usually been considered an either or selection, it has surprisingly been found that blends of mineral oil and polyol ester have low volatility and more constant viscosity during extended use than either mineral oils or polyol esters alone. Further the use of polyisobutylene oils as lubricants and thickeners allows the use of lower viscosity mineral oil and polyol ester. The blend of these three components provides a chain lubricant with minimal tendency to form deposits and low viscosity change over the use period and low volatility. The ratio of the three oils is desirably 10 or 20–50 or 60 wt. % mineral oil; 20–50 wt. % polyisobutylene, and 20–60 wt. % polyol ester. Conventional antioxidants, corrosion inhibitors, lubricity aids, and antiwear additives are also used.

DETAILED DESCRIPTION OF INVENTION

Various chains are used in industrial applications where components, parts, and subassemblies need to be moved through manufacturing steps of other series of steps. Often these processes require the components, parts of subassemblies and the chain carrying them to be exposed to elevated temperatures, such as above 125, 150 or 180° C. on a rotational basis. For the purposes of this specification these devices will be referred to as chain driven conveying devices or chain driven power transmission devices, depending upon whether their primary function is conveying things (e.g. single chain parts conveyor or multiple chain parts conveyor) or transmitting power (chain drive).

The chains used in these applications are designed for their ability to provide reliable transportation of clothes, components, parts, and subassemblies with minimal downtime, safety risks, and energy losses. The parts can be attached to the chains by hooks, clamps, other chains, tenters, etc. Alternately multiple chains (e.g. 2 or more) may be interconnected with bars, trays, baskets, buckets, etc and these additional elements may act as supports or otherwise implement the movement of components, parts, and subassemblies by the chains. The components, parts, and/or subassemblies may pass through spraying areas (e.g. paint or adhesive spraying), dip tanks, curing ovens, assembly stations, robotic operations, worker stations etc. while attached to the chains or while being moved by the chains. Multiple individuals lines using chains to transport clothes, components, parts, and/or subassemblies may be interconnected to manufacture articles.

While the prior paragraph is pertinent to assembly operations, chain conveyors are also used in a variety of treatment or processing plants where one or a variety of procedures are carried out on a material as it is moved along a conveying system. Such a process might include a chemical composition going through a calcining oven or where a material is taken through an oven to reduce moisture content.

A chain is an interconnected series of links often made of steel. The links may vary in both shape and size according to the function of the chain. Roller or silent chains are often used for both conveyors and for power transmission. A roller chain is of the type used on the bicycle. It consists of a series of rollers connected by side links fitted with pins that pass from one side link to an opposite side link through the rollers; this allows each link to act as a hinge. The rollers typically engage radial slots machined in sprockets, and the sprockets are attached to shafts that provide or receive the power. Roller chains typically are up to 99 percent efficient. They do not slip or require initial tension, and they may travel either backward or forward. The side links may be adapted to form hooks for hanging parts or to connect two or more chains together to carry trays, bars, etc for carrying parts of components in an assembly or manufacturing line.

The silent chain has a series of flat plates interleaved and/or riveted so that they form hinged units. The plates are shaped to fit the teeth of gear wheels or sprockets. An example of this type of chain is the timing gear is an automobile engine. They also engage gear wheels or sprockets that are connected to shafts.

The mineral oil in this specification can be any of the mineral oils with a viscosity of less than 300 cst at 40° C. These are predominantly obtained from petroleum distillation. A preferred mineral oil is a hydrogenated mineral oil. These are made by hydrogenating a conventional mineral oil to reduce the residual aliphatic unsaturation. Typically the aromatic unsaturation is partially or fully removed in this process. Typically the residual aliphatic unsaturation is reduced to less than 1% more desirably less than 0.3% based on the total carbon to carbon bonds in the oil. Hydrogenated mineral oils are commercially available from a variety of sources. Preferred mineral oils have a viscosity of from about 50 to 200 cst at 40° C. One such hydrogenated mineral oil is the Paraflex HT100 from Petro-Canada used in the examples below. Desirably the mineral oil is present in the blended lubricant in amount from about 10 or 20 to about 50 or 60 wt. of the blend of oils, more desirably from about 25 to about 45 wt. %, and preferably from about 25 to about 40 wt. % of the blend of oils. For the purpose of this specification an oil for the above weight determination is a liquid material at 40° C. with a viscosity of less than 100,000 cst.

The polyisobutylene in this application can be any of the available polyisobutylene with a number average molecular weight between about 900 and about 1600. One such oil is Amoco Indopol H-300 having a number average molecular weight of about 1330, used in the examples below. While these are characterized as poly(isobutylene) they may have up to 10 or 15 wt. % of repeating units from other monomers and fragments of polymerization initiators and terminators. Desirably the residue of at least 85 to 90 wt % of the repeating units are derived from polymerizing isobutylene. While these are used as viscosity index modifiers in lesser amounts in other applications, in this application they are used as an oil in the lubricant blend. These are well known commercial oils. Desirably the poly(isobutylene) is used in an amount from about 20 to about 50 wt. %, more desirably from about 25 to about 45 wt. %, and preferably from about 30 to about 45 wt. %.

The polyol ester can be any of the commercially available polyol esters having a viscosity at 40° C. of less than 300 cst. Polyol esters are generally the reaction product of a molecule having two or more hydroxyl groups and mono, di or polycarboxylic acids. Preferred carboxylic acids for this purpose of this specification are made predominantly from monocarboxylic acids. Preferred polyols for making the polyol ester are hindered polyols where the beta carbon atom from the oxygen atom of the polyol does not have any abstractable hydrogen atoms attached directly to it. Such polyols are known to result in polyol esters of improved thermal stability. Examples of such polyols include pentaerythritol, trimethylolalkanes such as trimethylolpropane, neopentyl glycols etc. These polyols of these esters are shown by formulae 1–5 in U.S. Pat. No. 5,711,165 hereby incorporated by reference. The polyol esters are desirably present in amounts from about 20 to 60 wt. %, more desirably from about 25 to 50 wt. % and preferably from about 30 to 50 wt. % based on the total oils in the lubricant blend. A typical polyol ester was used in Table 1 below. It was a technical grade ester from pentaerythritol and a blend of 70 wt. % normal octanoic acid and 30 wt. % normal decanoic acid.

The lubricant blend used to lubricate the chain desirably has a viscosity at 40° C. of from about 100 to about 400 cst, more desirably from about 150 to 350 cst as measured by ASTM D-445. It desirably has minimal volatility such as less than 10% loss in 24 hours at 202° C. as measure by placing 20 grams of lubricant in a 7 cm diameter aluminum dish and putting it in a 202° C. oven. Desirably the lubricant remains fluid and does not form a separate sludge layer for at least 2 weeks at 202° C. in the above test and more desirably it does not form a sludge in 3 or 5 weeks aging at 202° C.

The lubricant blend may include other conventional additives for lubricating oils including but not limited to antioxidants, detergents, dispersants, metal deactivators, antiwear agents, extreme-pressure agents, viscosity-index improvers, foam inhibitors, demulsifiers, friction modifiers, and corrosion inhibitors. Generally these additives would be used in a total amount from about 0.1 to 20 wt. % based on the total weight of the fully formulated lubricant.

A wide variety of antioxidant compositions can be used in combination with the oils of the invention. Examples of various types of antioxidants which can be used in combination with the lubricant blend include sulfur-containing compositions, aromatic amines including alkylated aromatic amines, phenols, oil-soluble transition metal containing compounds, etc. More particularly, the antioxidants useful in the present invention may be selected from phenolics, aromatic amines (e.g. L57 from Ciba Specialty Chemicals), phenothiazines, dithiophosphates, dithiocarbamates, sulfides, sulfurized olefins, sulfurized oils including vegetable oils, sulfurized fatty acids or esters, sulfurized Diels-Alder adducts, and tocopherols. These antioxidants are described in more detail including their method of manufacture in U.S. Pat. No. 5,773,391 herein incorporated by references for its teachings on additives to lubricating oils.

Small amounts of antioxidants interact with the oil blend of the present invention to provide highly stable lubricant. Generally, the lubricant can be stabilized with up to 5% by weight, based on the weight of the lubricant, of one or more antioxidant, and more often amounts of 3% or less of an antioxidant or mixture of antioxidants is effective in significantly improving the stability of the lubricant. Some of the antioxidants such as zinc dialkyl dithiophosphates and dialkyl dicarbamates also serve as antiwear additives.

In some embodiments, the antioxidant is a transition metal-containing composition. The transition metal-containing antioxidant is oil-soluble. The compositions generally contain at least one transition metal selected from titanium, manganese, cobalt, nickel, copper, and zinc, preferably manganese, copper, molybdenum, and zinc, more preferably copper. The metals may be in the form of nitrates, nitrites, halides, oxyhalides, carboxylates, borates, phosphates, phosphites, sulfates, sulfites, carbonates and oxides. The transition metal-containing composition is generally in the form of a metal-organic compound complex. The organic compounds include carboxylic acids and esters, mono- and dithiophosphoric acids, dithiocarbamic acids and dispersants. Generally the zinc dialkyl dithiophosphates, zinc dialkyl dicarbamates, and molybdenum dialkyl dithiophosphates are preferred, often in combination with a phenyl amine type antioxidant. Generally, the transition metal-containing compositions contain at least about 5 carbon atoms to render the compositions oil-soluble.

In another embodiment, the antioxidant is a dihydrocarbyl dithiophosphoric acid or dihydrocarbyl phosphorodithioic acid. Generally, each hydrocarbyl group independently contains from about 3 to about 30, or from about 3 up to about 12 carbon atoms. Useful phosphorus acid esters include those prepared by reacting phosphorus pentoxide with hydroxypropyl O,O-di(4-methyl-2-pentyl)phosphorodithioate (prepared by reacting di(4methyl-2-pentyl)-phosphorodithioic acid with 1.3 moles of propylene oxide at 25° C.) or O,O-di(isopropyl)phosphorodithioate (prepared by reacting diisopropyl phosphorodithioic acid with propylene oxide at 50° C.).

An antioxidant useful in the compositions of the present invention may be at least one metal dihydrocarbyl dithiophosphate characterized by the formula

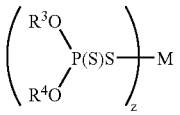

wherein $R^3$ and $R^4$ are each independently hydrocarbyl groups containing from 2 to about 24 carbon atoms, preferably from 3 to about 12, M is a metal, preferably zinc, copper, or molybdenum, and z is an integer equal to the valence of M.

The hydrocarbyl groups $R^3$ and $R^4$ in the dithiophosphate may be alkyl, cycloalkyl, aralkyl or alkaryl groups. Illustrative alkyl groups include isopropyl, isobutyl, n-butyl, sec-butyl, the various amyl groups, n-hexyl, methylisobutyl carbinyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this invention are prepared are well known. Examples of dihydrocarbyl phosphorodithioic acids and metal salts, and processes for preparing such acids and salts are found in, for example, U.S. Pat. Nos. 4,263,150; 4,289,635; 4,308,154; and 4,417,990. These patents are hereby incorporated by reference for such disclosures.

The metal salts of dihydrocarbyl dithiophosphates which are useful in this invention include those salts containing Group I metals, Group II metals, aluminum, lead, tin, molybdenum, manganese, cobalt, and nickel. Group I and Group II (including Ia, Ib, IIa and IIb) are defined in the Periodic Table of the Elements in the Merck Index, 11th Edition (1989). The Group II metals, aluminum, tin, iron, cobalt, lead, molybdenum, manganese, nickel and copper are among the preferred metals. Zinc and copper are especially useful metals. Examples of metal compounds which may be reacted with the acid include zinc hydroxide, copper hydroxide, copper oxide, zinc oxide, etc. Such compounds include ZDDP (Elco 102 from Elco Corp.) used in the examples and "Molyvan L" molybdenum di-(2-ethylhexyl) phosphorodithioate) or molybdenum dialkyldithiophosphate [MPMo] available from R T. Vanderbilt.

Especially useful metal phosphorodithioates can be prepared from phosphorodithioic acids which in turn are prepared by the reaction of phosphorus pentasulfide with mixtures of alcohols. In addition, the use of such mixtures enables the utilization of cheaper alcohols which in themselves may not yield oil-soluble phosphorodithioic acids or salts thereof. Thus a mixture of isopropyl and hexyl alcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; etc. Particularly useful alcohol mixtures are mixtures of secondary alcohols containing at least about 20 mole percent of isopropyl alcohol, and in a preferred embodiment, at least 40 mole percent of isopropyl alcohol.

Other antioxidants include metal thiocarbamates, such as zinc dioctyldithiocarbamate, or barium diheptylphenyl dithiocarbamate; dithiocarbamate esters, such as reaction products of an amine (e.g., butylamine), carbon disulfide, and one or more of the above unsaturated amide, ester, acid, or ether, such as acrylic, methacrylic, maleic, or fumaric acids, esters, or salts and acrylamides; and dithiocarbamates, such as alkylene coupled dithiocarbamates, which include methylene or phenylene coupled bis(butyldithiocarbamates), and bis-(s-alkyldithiocarbamoyl) disulfides, which are known and referred to as sulfur-coupled thiocarbamates. These type of compounds would include ZDDC known as Vanlube AZ from R. T. Vanderbilt used in the examples and molybdenum dialkyldithiocarbamates.

Generally, the oil compositions of the present invention will contain varying amounts of one or more of the above-identified metal (dihydrocarbyl) dithiophosphates, metal (dihydrocarbyl) dithiocarbamates, metal (dihydrocarbyl) phosphorothioates (optionally sulfurized) such as from about 0.01 to about 2% by weight, and more generally from about 0.01 to about 1% by weight based on the weight of the total oil composition. The metal dithiophosphates are added to the lubricating oil compositions of the invention to improve the anti-wear and antioxidant properties of the oil compositions.

In addition to the antioxidants it is desirable to add lubricity agents like polyorganosiloxanes (silicone oils) to the blend in an effective amount to aid in the lubrication of the chain(s). These are generally used in amounts from about 0.1 to 3 or 5 wt. % based on the weight of the total oils in the lubricant blend, and more desirably from about 0.5 to 2.5 wt. %. Preferred poly(organosiloxanes) are alkylarylpolysiloxanes or dialkylpolysiloxanes such as 203 or 200 oils from Dow Corning. It is also desirable to incorporate corrosion inhibitors into the lubricant blend to protect the metal parts from various corrosive materials such as ozone, acids, water, and corrosive gases. A preferred corrosion inhibitor is barium sulfonate, which is readily commercially available as BSN-HT-PE2 from King Industries. Other conventional corrosion inhibitors can be used in lieu of barium sulfonate or in addition to barium sulfonate.

Depending on the particular application and the stresses on the chain it may be desirable to incorporate extreme pressure or antiwear additives into the formulation. These would minimize wear on the chain parts attributed to the various parts being in moving contact with other metal parts while under pressure. The zinc dialkyl dithiophosphates and zinc dialkyl dithiocarbamates in the examples performed some of this function. Extreme pressure additives are commercially available and well known to the art.

In one embodiment, the antiwear additive is a phosphorus acid ester prepared by reacting phosphorus acid or anhydride with an alcohol containing from one to about 30, or from about 3 to about 12 carbon atoms. The phosphorus acid or anhydride is generally an inorganic phosphorus reagent, such as phosphorus pentoxide, or a phosphorus sulfide, including phosphorus pentasulfide. Examples of useful phosphorus acid esters include the phosphoric acid esters prepared by reacting a phosphoric acid or anhydride with cresol. An example of these phosphorus acid esters is tricresylphosphate. Tricresylphosphate was used in the following examples and it is also considered as a lubricity agent. It is commercially available as Syn-o-add 8484 from AKZO Chemie America.

The lubricant in conveyor chain application functions to minimize wear and friction on the chain parts, to keep the chain clean, to provide effective lubrication at higher temperatures, and to penetrate the crevices of the chain providing both lubrication and corrosion inhibition.

The improved blend uses a cost effective hydrogenated mineral oil as one component, reduces the tendency of the lubricant oils to 1) break down into lower molecular weight products that are volatilized, 2) break down into products that form higher molecular weight sludge or varnish, and 3) change viscosity.

EXAMPLES

Table 1 compares the volatility a blend according to this disclosure to the volatility of the three starting oils. All of the oils include 2.5% Ba sulfonate (BSN-HT-PE2), 1.5% polysiloxane (DC 203 from Dow Corning), 1% tricresyl phosphate (Syn-o-add 8484), 0.1% ZDDP (Elco 102 from Elco Corp.), 0.1% ZDDC (Vanlube AZ from R. T. Vanderbilt), and 2% phenylamine (L-57 from Ciba Speciality Chemcials) based on the weight of the oil blend. The blend comprises Amoco Indopol H-300 polybutene (PIB) having a number average molecular weight of about 1330; a technical grade of polyol ester (POE) from pentaerythritol and a 70:30 wt ratio blend of normal $C_8$ and normal $C_{10}$ monocarboxylic acids; and a hydrotreated mineral oil Paraflex HT-100 from Petro-Canada (MO). The weight ratios of the components were 33 PIB, 37 POE, and 30 MO. The viscosities of the lubricants at 40° C. using ASTM D-445 are giving in Table 1 below. The amount of volatiles lost by each lubricant is also given in the table.

The volatility/weight loss of a POE/PIB/MO (37/33/30) blend (Chain 192) is compared to each of its component with exactly the same additive package in Table 1. In addition to the problem that the viscosity of these individual components are out of the range needed by a chain oil (generally requiring 150–350 cst at 40° C.), they all have a higher volatility compared to the blend. Since low volatility is a critical property needed for a high temperature chain lubricant, the blend provides synergistic and surprising benefit.

TABLE 1

Comparisons of Volatility and Weight Loss of the Chain Oil Blend with each of its Components

| | Viscosity (40° C., cSt) | *Volatility at 202° C. after 42 Hr (% wt. loss) |
|---|---|---|
| Chain oil 192 (blend of POE/PIB/MO) | 290 | 12 |
| POE | 32 | 15 |

TABLE 1-continued

Comparisons of Volatility and Weight Loss of the Chain Oil Blend with each of its Components

| | Viscosity (40° C., cSt) | *Volatility at 202° C. after 42 Hr (% wt. loss) |
|---|---|---|
| PIB | 23500 | 35 |
| MO | 109 | 28 |

*Volatility was measured by percentage of weight loss of 20 gram samples in thin films in 7 cm diameter aluminum pans.

Ester lubricants have good thermal/oxidative stability compared to PIB or hydrotreated (MO) mineral oils. The stability/volatility of the POE/PIB/MO blend are compared to two ester lubricants with the same additive package in Table 2. These ester lubricants were chosen to have viscosity grades of ISO 320 (suitable viscosity for chain lubrication) that make them suitable for high temperature applications. Both polyol esters are the reaction product of 21 wt. % adipic acid, 50 wt. % of a blend of $C_8$ and $C_{10}$ monocarboxylic acids and 28 wt. % of trimethylolpropane. The results in Table 2 demonstrate that both the stability and volatility of the blend (Chain oil 192) is significantly better than Ester 1. This will translate into a better performance with major cost advantage. While the viscosity and volatility data in Table 2 demonstrate that Ester 2 outperforms the Chain oil 192 on both the volatility and stability under the 1-week test condition, Ester 2 showed abrupt properties deterioration if the test time was prolonged resulting in sludge, lack of fluidity at 25 C, and substantial weight loss after 20 days. Chain lubricant 192 retained fluidity after 20 days and had less weight loss. These results are important since in applications a chain lubricant, once applied generally is not removed. Consequently, Ester 1 when compared to Chain 192, would form sludge/deposits quicker and needs to be replenished at a faster rate. Ester 2 when compared to Chain oil 192 would need to be replenished more often to avoid jamming the chain. The data demonstrate that the POE/PIB/MO blend Chain oil 192 not only provides a significant cost advantage but can also outperform ester-based lubricants.

TABLE 2

Comparisons of Viscosity Increase and Volatility (Weight loss) of Chain Oil Formulations after Aging at 202° C.

| | | 42 hr | 90 hr | 168 hr | 480 hr |
|---|---|---|---|---|---|
| Chain oil 192 | Viscosity (cst, 40° C.) Initial: 290 cSt | 370 | 454 | 650 | Fluid at 25° C. |
| | Volatility (%) | 12 | 18 | 25 | 51 |
| Ester 1 | Viscosity (cst, 40° C.) Initial: 314 cSt | 539 | 738 | >1000 | na |
| | Volatility (%) | 16 | 22 | 31 | na |
| Ester 2 | Viscosity (cst) Initial: 310 cSt | 409 | 450 | 510 | No fluidity at 25° C. and sludge present |
| | Volatility (%) | 6 | 10 | 12 | 80 |

*Tests are conducted at 202° C. in air.

One way to further reduce the cost is to use a high concentration of MO mineral oil and/or take out the POE in the blend. The idea was examined and results presented in Table 3. Chain oil 204 is composed of PIB/MO (18.5/81.5) and Chain 205 composed of POE/PIB/MO (5/75/20). Data in Table 3 show that by eliminating the POE (Chain oil 204) or reducing it to a low level (Chain oil 205), the stability and volatility of the lubricants would deteriorate significantly. In addition, long term tests demonstrate that both Chain 204 and Chain 205 lost their fluidity and formed sludge in less than 20 days. These results indicate the importance of using a POE/PIB/MO blend and keeping the blend ratio in the range specified.

TABLE 3

Comparisons of Viscosity Increase and Volatility/Weight of Various Blends

| | | 42 hr | 90 hr | 168 hr | 480 hrs |
|---|---|---|---|---|---|
| Chain 192 (37/33/30) | Viscosity (cst, 40° C.) Initial: 290 cSt | 370 | 454 | 650 | Still fluid |
| | Volatility (%) | 12.4 | 18 | 25 | |
| Chain 204 (0/18.5/81.5) | Viscosity (cst, 40° C.) Initial: 281 cSt | 495 | 550 | 764 | Formed sludge |
| | Volatility (%) | 18 | 30 | 44 | |
| Chain 205 (5/75/20) | Viscosity (cst) Initial: 280 cSt | 401 | 537 | 705 | Formed sludge |
| | Volatility (%) | 17 | 27 | 38 | |

*Tests are conducted at 202° C. in air.

Overall, the surprising effects of the invention include the low volatility and excellent stability especially considering there is a mineral oil in the example Chain oil 192 formulation. In theory, the mineral oil, due to its poor oxidative stability, should degrade fast at over 200° C. and release lots of free radicals. These free radicals can attack the PIB and POE resulting in a formulation of poor stability. Also, the low molecular weight portion of the MO and the low viscosity of the POE used in the example Chain 192 should increase the volatility especially compared to a high viscosity POE. Therefore it is surprising to find this is not the case.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lubricating a chain used for conveying articles or power comprising;

a) applying to the chain a lubricant comprising:

1) from about 20 to about 50 wt. % of a poly(isobutylene) oil having a number average molecular weight from about 900 to about 1600, 2) from about 20 to about 60 wt. % of a polyol ester oil, and 3) from about 10 to about 60 wt. % of a mineral oil, wherein said wt. % values are based on the total oils in said lubricant, b) allowing the lubricant to distribute itself over portions of the chain during normal operation.

2. A method according to claim 1 wherein said chain and said lubricant are exposed to temperatures in excess of 150 C in a heated environment during normal operation.

3. A method according to claim 1, wherein said lubricant includes an antioxidant, a corrosion inhibitor and an extreme pressure additive.

4. A method according to claim 1, wherein said lubricant includes from about 0.1 to about 5 wt. % of a silicone oil.

5. A method according to claim 1, wherein the amount of said poly(isobutylene) is from about 25 to about 45 wt. % of said oils of said lubricant.

6. A method according to claim 1, wherein said polyol ester is from about 30 to about 50 wt. % of said lubricant.

7. A method according to claim 1, wherein said polyol ester is an ester derived from a hindered aliphatic polyol and one or more monocarboxylic acids having from 4 to 20 carbon atoms.

8. A method according to claim 1, wherein said mineral oil has less than 1% unsaturation based on the total carbon to carbon bonds in the mineral oil.

9. A chain conveying system comprising:

a) a conveying chain and b) a lubricant on the chain comprising:

1) from about 20 to about 50 wt. % of a poly(isobutylene) oil having a number average molecular weight from about 900 to about 1600, 2) from about 20 to about 60 wt. % of a polyol ester oil, and 3) from about 10 to about 60 wt. % of a mineral oil, wherein said wt. % values are based on the total oils in said lubricant.

10. A system according to claim 9, wherein said chain and said lubricant are exposed to temperatures in excess of 150 C in a heated environment during normal operation.

11. A system according to claim 9, wherein said lubricant includes an antioxidant, a corrosion inhibitor and an extreme pressure additive.

12. A system according to claim 9, wherein said lubricant includes from about 0.1 to about 5 wt. % of a silicone oil.

13. A system according to claim 9, wherein the amount of said poly(isobutylene) is from about 25 to about 45 wt. % of said oils of said lubricant.

14. A system according to claim 9, wherein said polyol ester is from about 30 to about 50 wt. % of said lubricant.

15. A system according to claim 9, wherein said polyol ester is an ester derived from a hindered aliphatic polyol and one or more monocarboxylic acids having from 4 to 20 carbon atoms.

16. A system according to claim 9, wherein said mineral oil has less than 1% unsaturation based on the total carbon to carbon bonds in the mineral oil.

* * * * *